US006004206A

United States Patent [19]

Fabri

[11] Patent Number: 6,004,206

[45] Date of Patent: Dec. 21, 1999

[54] WEBBERY GAME

[76] Inventor: Jeroen Fabri, Lispersteenweg 113 2530, Boechout, Belgium

[21] Appl. No.: 09/050,273

[22] Filed: Mar. 30, 1998

[51] Int. Cl.[6] ..... A63F 9/22

[52] U.S. Cl. ..... 463/17; 273/269

[58] Field of Search ..... 463/16, 17, 18, 463/19, 20, 13, 12, 42, 41, 40; 273/269, 139, 274

[56] References Cited

U.S. PATENT DOCUMENTS

| | | | |
|---|---|---|---|
| 5,108,115 | 4/1992 | Berman et al. . | |
| 5,213,337 | 5/1993 | Sherman . | |
| 5,265,888 | 11/1993 | Yamamoto et al. . | |
| 5,297,802 | 3/1994 | Pocock et al. . | |
| 5,423,556 | 6/1995 | Latypov . | |
| 5,540,441 | 7/1996 | Slan et al. | 273/269 |
| 5,545,088 | 8/1996 | Kravitz et al. . | |
| 5,569,082 | 10/1996 | Kaye | 463/17 |
| 5,630,753 | 5/1997 | Fuchs . | |
| 5,679,075 | 10/1997 | Forrest et al. . | |
| 5,695,400 | 12/1997 | Fennell, Jr. et al. . | |
| 5,836,816 | 11/1998 | Bruin et al. | 463/16 |

*Primary Examiner*—Michael O'Neill
*Attorney, Agent, or Firm*—Tipton L. Randall

[57] ABSTRACT

The invention is a method for conducting an interactive lottery game. The game players select both an integer N and a rank R for that integer during a series of game playing intervals. The selections are entered into a computerized tallying database along with a unique personal identifier for each player. The database tabulates all player's selections and generates a most frequently selected rank R and an associated integer N for each playing interval. A game winner is determined by comparing every player's selection of integer N and rank R for each game interval with the most frequently selected rank R and associated integer N for each game interval. A prize is awarded to the winning player.

20 Claims, No Drawings

WEBBERY GAME

FIELD OF THE INVENTION

The present invention relates to a lottery game, and more particularly to an interactive lottery game suitable for the Internet.

BACKGROUND OF THE INVENTION

Lottery type games are well known throughout the world, attracting large numbers of players by offering large prizes. In general, players pick a selection of numbers from a defined range of numbers. Then, at a later time, another single selection of numbers from that defined number range is randomly made. The individual or individuals having made a selection of numbers matching the single randomly made selection is declared the winner and receives a prize.

A number of innovations have been developed relating to various games that allow a large number of individuals to participate with an opportunity to receive a prize. The following U.S. patents are representative of some of those innovations.

Berman et al., in U.S. Pat. No. 5,108,115, disclose an interactive communication system for game participants. Game show audience members and home viewer members pick six numbers from a total pool of numbers. Six random numbers are then selected from the pool, with an individual's selection that matches the random selection winning a prize.

In U.S. Pat. No. 5,213,337 Sherman describes a device for playing a game that receives audio signals from a broadcast, then processes the signals to present questions to the player, the questions based on the content of the broadcast.

Yamamoto et al, in U.S. Pat. No. 5,265,888, disclose a computer game apparatus having selectable levels of difficulty which may be chosen by the individual players.

In U. S. Pat. No. 5,297,802 Pocock et al. describe a televised bingo game system for viewer participation. The players use telephone communication to participate. The system is designed to be totally automated, and has no staff to accept player entries or to operate the televising of the game.

Latypov, in U.S. Pat. No. 5,423,556, discloses an interactive computer game employing a digital computer system with a display and an interactive means for communicating user input to the computer system. The user is given a set time interval to arrange an array of elements on the display to form a predetermined pattern of the elements.

In U.S. Pat. No. 5,545,088 Kravitz et al. describe a television game interactively played by home viewers, a studio audience and on-stage contestants. The game is similar to bingo with the numbers chosen randomly or selected by the contestants upon correctly answering a question.

Fuchs, in U.S. Pat. No. 5,630,753, discloses a gaming machine having a computing unit that displays various symbols. The computing unit predicts the probability of a future occurrence based on the present status of a game.

In U.S. Pat. No. 5,679,075 Forrest et al. describe an interactive multi-media game system where players solve puzzles to progress through a game maze in order to solve a global meta-puzzle.

Fennell, Jr., et al., in U.S. Pat. No. 5,695,400, disclose a method of managing user inputs and displaying outputs in a multi-player game that is played on a plurality of terminals on a network in a manner that compensates for differences in network latency among different terminals.

Thus, it can be seen that for many of the above inventions, the winner or winners are determined strictly based on random probability. In other inventions, the quick recall of facts or the capacity for manual dexterity are responsible for determining the winner. Thus, there exist an unmet need for an interactive game where the input of each player has an effect on determining the outcome of the game, and accordingly the winner or winners.

SUMMARY OF THE INVENTION

The invention is a method for conducting an interactive lottery game. The method comprises the steps of selecting a range of different integers N with a range 1 through N, then selecting a range of different ranks R with ordinal range R-1st through R-nth, where n is less than N, and then selecting a range of different game playing intervals L with a range $L_1$ through $L_x$. During a first game playing interval $L_1$, players select one integer N and one rank R for entry into a computerized tallying database, with each player's selection associated with a unique personal identifier.

The computerized database tallies the frequency of selection for each different integer N and frequency of selection for each different rank R for the first game playing interval $L_1$. The computerized database then produces a one-to-one correlation set between the ordinal range ranks R-1st through R-nth, with each rank having an associated frequency of selection, and the integers N, each integer having an associated frequency of selection, with the integers N arranged in decreasing order of frequency of selection for correlation with the ordinal ranks, in the first game playing interval $L_1$. The player's selection of one rank R and one integer N, the tallying of the selections, and the correlation to produce a different one-to-one correlation sets of ordinal range ranks R-1st through R-nth and integers N arranged in decreasing order of frequency of selection, occur for each designated playing interval L. In an alternative embodiment, the player makes selections of ranks R and integers N for all playing intervals $L_1$ through $L_x$, and enters these various selections at any time during the total game duration.

A game winner is determined by comparing every player's selection of integer N and rank R for each game playing interval L with the most frequently selected rank R and integer N associated with the most frequently selected rank R in the one-to-one correlation set for each corresponding game playing interval L. A prize is awarded to the winning player.

DESCRIPTION OF THE PREFERRED EMBODIMENTS

The present invention is an interactive lottery game developed specifically for play over the Internet or World Wide Web, for example. The game is interactive because the actual outcome of the game is completely determined by the interaction of a great number of players worldwide. This is in contrast to the traditional lottery games, where the result of the game is determined by an external event, such as a drawing of random numbers. Each interactive lottery game is played over a measured period of time, which is determined before the start of the game. The length of the time period can vary from one or more weeks to several months, with the result of the game determined at the end of that measured time period.

Definitions

As utilized herein, including the claims, the term "integer" references a positive whole number.

As utilized herein, including the claims, the term "ordinal range" references a constant order of ranks.

As utilized herein, including the claims, the term "playing interval" references a fractional time period of the total duration of a lottery game.

As utilized herein, including the claims, the term "tallying database" references a computerized software program for recording and storing a lottery player's selections, and includes an associated unique personal identifier.

As utilized herein, including the claims, the term "one-to-one correlation set" references a set of data containing an ordinal range of ranks, with each rank correlated with one integer, and the integers arranged in decreasing order of frequency of selection for a playing interval in a lottery game.

As utilized herein, including the claims, the term "following interval" references the game playing interval $L_{n+1}$ with regard to the game playing interval $L_n$, with game playing interval $L_1$ the following interval for a final game playing interval.

Playing the Game

The duration of the interactive lottery game is first established. In this example the duration is six weeks. The total duration is divided into shorter game playing intervals, denoted as $L_x$ for "levels". For a game duration of six weeks, each level, L, could be one week, resulting in six game playing intervals, i.e. level one, $L_1$, through level six, $L_6$.

For each total game, one range of different integers N is designated, with the range being 1 through N. Likewise, one range of different ranks R is designated, the range being ordinal from R-1st through R-nth, where n is less than N. For example, the integer range is selected as 1 through 47, and the rank range is selected as rank-first through rank-sixth, with the order of the rank range being constant for the total game duration. During each game playing interval, a player selects one rank R and one integer N. The rank R is selected based on how frequently the player believes the integer N he chooses will be chosen by other game player for that particular game playing interval. The player enters his choices into a computerized tallying database, along with an associated unique personal identifier so that his selections can be verified at a later date.

Each time a player selects a rank R and an integer N and enters this choice into the database, (in total six times, as there are six playing intervals for this particular example game), the selected rank and selected integer receives one "hit" in the database tally. As additional participants make their selections and enter them into the database for the particular playing level, there are generated two separate and mutually independent hierarchies based on frequency of selection of ranks and of integers. The ranks are ordinal in that their order is always rank-first, rank-second, rank-third, etc. The tallying database correlates the most frequently selected integer with rank-first, the second most frequently selected integer with rank-second, etc., as well as tallying the number of "hits" each rank receives. Thus, a one-to-one correlation set of ranks and integers is produced for each game playing interval. The more "hits" a rank or integer receives, the higher it finishes in the final standings for that particular playing level. Also, note that only the six most frequently selected integers per level potentially determine the final outcome of the game in this example. Additionally, the standings for all levels, as maintained in the computerized tallying database, are not known to the participants during the total duration of the game.

To better understand the details of the interactive lottery game the following examples are presented. Below is the situation for example game playing interval $L_4$ before player XYZ selects one rank and one integer for that level.

TABLE 1

EXAMPLE FOR LEVEL 4

| Rank | Integer | Hits/Integer | Hits/Rank |
|---|---|---|---|
| Rank 1st | 19 | 523 | 1345 |
| Rank 2nd | 27 | 518 | 1456 |
| Rank 3rd | 35 | 512 | 1167 |
| Rank 4th | 47 | 509 | 1371 |
| Rank 5th | 3 | 498 | 1311 |
| Rank 6th | 12 | 487 | 1398 |

Suppose that player XYZ believes the fifth (Rank) most frequently selected integer for the fourth level, or interval $L_4$, will be the integer 47. Player XYZ selects and enters rank=5, integer=47. The new situation for interval $L_4$ after player XYZ's input is:

TABLE 2

EXAMPLE FOR LEVEL 4

| Rank | Integer | Hits/Integer | Hits/Rank |
|---|---|---|---|
| Rank 1st | 19 | 523 | 1345 |
| Rank 2nd | 27 | 518 | 1456 |
| Rank 3rd | 35 | 512 | 1167 |
| Rank 4th | 47 | (509 + 1) | 1371 |
| Rank 5th | 3 | 498 | (1311 + 1) |
| Rank 6th | 12 | 487 | 1398 |

Thus, the ordering of the ranks remain constant during each playing interval L, although the "hits" tally for each rank changes as each player makes his selection. The ordering or "ranking" of the integers can vary during each playing interval, depending upon the number of "hits" each integer receives. The greater the number of "hits" for an integer, the higher the ranking or placement for a particular playing interval L.

In an alternative embodiment of the invention, players have the option of entering their selections of rank R and integer N for each playing interval $L_1$ through $L_x$ at any time during the total game duration. Since the results for all playing intervals $L_1$ through $L_x$ are kept secret until the end of the game playing period, the entering of selections at any particular playing interval cannot influence the selections made at a later time.

The End of The Playing Period

The results for a hypothetical interactive lottery game are presented in the attached Table 6. The game playing period is finished, and the tally for each game playing interval shown. The winning rank R for each playing interval L is the rank R that receives the greatest number of "hits", while the winning integer N is the integer correlated with the winning rank, even though the winning integer has received fewer "hits" than those integers placed higher in the integer frequency of selection list. As seen for playing interval $L_4$ in Table 6, the winning rank is rank-sixth and the winning integer is the correlated integer 12. Thus, the winning results for the example game from Table 6 are as shown below.

TABLE 3

SUMMARY OF FINAL RESULTS

| Level | Rank | Integer |
|---|---|---|
| $L_1$ | Rank 2nd | 19 |
| $L_2$ | Rank 5th | 27 |
| $L_3$ | Rank 6th | 27 |
| $L_4$ | Rank 6th | 12 |
| $L_5$ | Rank 1st | 3 |
| $L_6$ | Rank 6th | 1 |

The game winner is determined by comparing every player's selection of integer N and rank R for each game playing interval L, with the winning results shown above. The player or players selecting the above combination of ranks and integers for the specified levels, or selecting the closest combination thereof, is declared the winner. The player's selections and unique personal identifier are confirmed from the computerized database. Alternatively, a specially printed ticket may be generated from computers used in entering the player's selection, as is done with many of the random number lottery games presently available in the United States for game players.

There may occur situations where integers N and/or ranks R finish with the same selection frequency or number of "hits" for one or more playing intervals or levels L. In these situations the final hierarchy position of integers having equal selection frequency for one playing interval $L_n$ is determined by the relative hierarchy position for each integer found in the following playing interval $L_{n+1}$. Likewise, the winning rank for multiple ranks having equal selection frequency for one playing interval $L_n$ is determined by the corresponding rank selection frequency for each corresponding rank found in the following playing interval $L_{n+1}$. The "following" playing interval for the last playing interval is defined as the first playing interval for breaking ties for both integers N and ranks R. The following presents an example of the determination of the winning rank, and thereby the winning integer, where two ranks finish with the greatest and equal number of "hits" for one playing interval. Suppose that the final results for playing interval $L_4$ is as follows:

TABLE 4

TIE BREAKING

| Level $L_4$ | Rank | Integer | Hits/Rank |
|---|---|---|---|
| | Rank 1st | 19 | 2356 |
| | Rank 2nd | 27 | 2482 |
| | Rank 3rd | 35 | 2279 |
| | Rank 4th | 47 | 2199 |
| | Rank 5th | 3 | 2356 |
| | Rank 6th | 12 | 2482 |

In this example both rank-2nd and rank-6th received the highest number of "hits", which is in this case 2482 each. In this situation, the following level, level $L_5$, is used to determine the winning rank for level $L_4$. The final standings for level $L_5$ are shown below, where rank-6th received a higher number of "hits" than rank-2nd, 2311 vs. 2302. Consequently in level $L_4$, the winning rank is rank-6th, thus making the winning integer 12. Should level $L_5$ also result in a tie for rank-2nd and rank-6th, the following level, $L_6$, is used to determine the winning rank in the same fashion as described above. As stated above, the "following" playing interval for the last playing interval is defined as the first playing interval for breaking ties for both integers N and ranks R.

TABLE 5

TIE BREAKING

| Level $L_5$ | Rank | Integer | Hits/Rank |
|---|---|---|---|
| | Rank 1st | 29 | 2134 |
| | Rank 2nd | 10 | 2302 |
| | Rank 3rd | 21 | 2432 |
| | Rank 4th | 25 | 2005 |
| | Rank 5th | 5 | 2398 |
| | Rank 6th | 20 | 2311 |

Should no player correctly select all ranks and integers for each playing interval for the lottery game final results, the player with the most correct ranks is declared the winner. For players with equal numbers of correctly selected ranks, the player with the greatest number of correctly selected integers is declared the winner. Should two or more players finish with equal numbers of both correctly selected ranks and integers, the prize is divided between them.

While the invention has been particularly shown and described with reference to a preferred embodiment thereof, it will be understood by those skilled in the art that various changes in form and details may be made therein without departing from the spirit and scope of the invention.

TABLE 6

DETAILED FINAL RESULTS

| Rank | Integer | Hits/Integer | Hits/Rank | Winning Rank | Winning Integer |
|---|---|---|---|---|---|
| | | Level 1 | | | |
| Rank 1st | 2 | 526 | 1980 | | |
| Rank 2nd | 19 | 517 | 2334 | 2nd | 19 |
| Rank 3rd | 11 | 511 | 2308 | | |
| Rank 4th | 34 | 509 | 2145 | | |
| Rank 5th | 42 | 491 | 2170 | | |
| Rank 6th | 18 | 480 | 2205 | | |
| (7th) | 9 | 479 | none | | |
| . . . | . . . | . . . | . . . | | |
| (47th) | 12 | 331 | none | | |
| | | Level 2 | | | |
| Rank 1st | 5 | 523 | 2134 | | |
| Rank 2nd | 23 | 517 | 2001 | | |
| Rank 3rd | 35 | 509 | 2053 | | |
| Rank 4th | 7 | 507 | 2290 | | |
| Rank 5th | 27 | 489 | 2366 | 5th | 27 |
| Rank 6th | 3 | 478 | 2298 | | |
| (7th) | 31 | 464 | none | | |
| . . . | . . . | . . . | . . . | | |
| (47th) | 25 | 319 | none | | |
| | | Level 3 | | | |
| Rank 1st | 20 | 523 | 2334 | | |
| Rank 2nd | 17 | 518 | 1954 | | |
| Rank 3rd | 7 | 512 | 2167 | | |
| Rank 4th | 18 | 509 | 2182 | | |
| Rank 5th | 10 | 498 | 2147 | | |
| Rank 6th | 27 | 487 | 2358 | 6th | 27 |
| (7th) | 6 | 476 | none | | |
| . . . | . . . | . . . | . . . | | |
| (47th) | 36 | 322 | none | | |
| | | Level 4 | | | |
| Rank 1st | 29 | 523 | 1998 | | |
| Rank 2nd | 37 | 518 | 2011 | | |
| Rank 3rd | 35 | 512 | 2134 | | |
| Rank 4th | 19 | 509 | 2345 | | |
| Rank 5th | 3 | 498 | 2287 | | |

TABLE 6-continued

DETAILED FINAL RESULTS

| Rank | Integer | Hits/Integer | Hits/Rank | Winning Rank | Winning Integer |
|---|---|---|---|---|---|
| Rank 6th | 12 | 487 | 2367 | 6th | 12 |
| (7th) | 31 | 481 | none | | |
| . . . | . . . | . . . | . . . | | |
| (47th) | 8 | 322 | none | | |
| | | Level 5 | | | |
| Rank 1st | 3 | 536 | 2312 | 1st | 3 |
| Rank 2nd | 39 | 516 | 2309 | | |
| Rank 3rd | 23 | 508 | 2031 | | |
| Rank 4th | 11 | 503 | 2157 | | |
| Rank 5th | 9 | 501 | 2198 | | |
| Rank 6th | 28 | 499 | 2135 | | |
| (7th) | 24 | 485 | none | | |
| . . . | . . . | . . . | . . . | | |
| (47th) | 34 | 324 | none | | |
| | | Level 6 | | | |
| Rank 1st | 46 | 524 | 2295 | | |
| Rank 2nd | 43 | 523 | 2231 | | |
| Rank 3rd | 22 | 519 | 2326 | | |
| Rank 4th | 24 | 500 | 1973 | | |
| Rank 5th | 9 | 489 | 1987 | | |
| Rank 6th | 1 | 483 | 2330 | 6th | 1 |
| (7th) | 11 | 476 | none | | |
| . . . | . . . | . . . | . . . | | |
| (47th) | 40 | 314 | none | | |

I claim:

1. A method for conducting an interactive lottery game comprising the steps:

a) selecting a range of different integers N with a range 1 through N;

b) selecting a range of different ranks R with ordinal range R-1st through R-nth, where n is less than N;

c) selecting a range of different game playing intervals L with a range $L_1$ through $L_x$;

d) selecting by players of an integer N and a rank R, each selection associated with one of said different game playing intervals $L_1$ through $L_x$, for entry into a computerized tallying database, each player's selection associated with a unique personal identifier;

e) tallying, by said computerized database, frequency of selection for each different integer N and frequency of selection for each different rank R for each of said game playing intervals $L_1$ through $L_x$, to produce a one-to-one correlation set between said ordinal range ranks R-1st through R-nth, each rank having a frequency of selection associated therewith, and said integers N, each integer having a frequency of selection associated therewith, said integers N arranged in decreasing order of frequency of selection for correlation with said ordinal range ranks, each one-to-one correlation set derived from the players selections designated for one of said game playing intervals $L_1$ through $L_x$;

f) determining a game winner by comparing every player's selection of rank R and integer N for each game playing interval $L_1$ through $L_x$, with the most frequently selected rank R and integer N associated with said most frequently selected rank R in said one-to-one correlation set for each corresponding game playing interval $L_1$ through $L_x$, and g) awarding a prize to the winning player.

2. A method according to claim 1 wherein said integers range is one (1) through forty-seven (47).

3. A method according to claim 1 wherein said rank ordinal range is first (1st) through sixth (6th).

4. A method according to claim 1 wherein said playing interval range is one (1) through six (6).

5. A method according to claim 1 wherein two or more of said ordinal range ranks are selected with equal frequency and are most frequently selected ranks for a game playing interval $L_n$, the winning rank is determined from the corresponding rank having the higher frequency of selection for game playing interval $L_{n+1}$.

6. A method according to claim 1 wherein two or more of said integers are selected with equal frequency for a game playing interval $L_n$ the integer placed higher in said decreasing order of frequency of selection for integers is determined from the corresponding integer having the higher frequency of selection for game playing interval $L_{n+1}$.

7. A method according to claim 1 wherein said game winning player's selection matches the most frequently selected rank R and integer N associated with said most frequently selected rank R in said one-to-one correlation set for each corresponding game playing interval L.

8. A method according to claim 1 wherein no game player's selection matches the most frequently selected rank R and integer N associated with said most frequently selected rank R in said one-to-one correlation set for each corresponding game playing interval L, said game winning player's selection matches the greatest number of most frequently selected rank R for each game playing interval L.

9. A method according to claim 1 wherein no game player's selection matches the most frequently selected rank R and integer N associated with said most frequently selected rank R in said one-to-one correlation set for each corresponding game playing interval L, two or more players selection matches an equal number of most frequently selected rank R for each game playing interval L, said game winning player's selection matches the greatest number of integers N associated with said most frequently selected rank R for each game playing interval L.

10. A method according to claim 1 wherein no game player's selection matches the most frequently selected rank R and integer N associated with said most frequently selected rank R in said one-to-one correlation set for each corresponding game playing interval L, two or more players selection matches an equal number of most frequently selected rank R for each game playing interval L, and an equal number of integers N associated with said most frequently selected rank R for each game playing interval L, said players having made said selections share said awarded prize.

11. A method for conducting an interactive lottery game comprising the steps:

a) selecting a range of different integers N with a range 1 through N;

b) selecting a range of different ranks R with ordinal range R-1st through R-nth, where n is less than N;

c) selecting a range of different game playing intervals L with a range $L_1$ through $L_x$;

d) selecting by players, during a first game playing interval $L_1$, one integer N and one rank R associated with said first interval $L_1$, for entry into a computerized tallying database, each player's selection associated with a unique personal identifier;

e) tallying, by said computerized database, frequency of selection for each different integer N and frequency of selection for each different rank R for said first game playing interval $L_1$, to produce a one-to-one correlation set between said ordinal range ranks R-1st through R-nth, each rank having a frequency of selection associated therewith, and said integers N, each integer having a frequency of selection associated therewith, said integers N arranged in decreasing order of frequency of selection for correlation with said ordinal range ranks, said one-to-one correlation set associated with said first game playing interval $L_1$;

f) repeating steps d) and e) to produce $L_x$ different one-to-one correlation sets of ordinal range ranks R-1st through R-nth and integers N, said integers arranged in a decreasing order of frequency of selection for correlation with said ordinal range ranks, each one-to-one correlation set associated with a designated playing interval L;

g) determining a game winner by comparing every player's selection of rank R and integer N for each game playing interval $L_1$ through $L_x$ with the most frequently selected rank R and integer N associated with said most frequently selected rank R in said one-to-one correlation set for each corresponding game playing interval $L_1$ through $L_x$; and h) awarding a prize to the winning player.

12. A method according to claim 11 wherein said integers range is one (1) through forty-seven (47).

13. A method according to claim 11 wherein said rank ordinal range is first (1st) through sixth (6th).

14. A method according to claim 11 wherein said playing interval range is one (1) through six (6).

15. A method according to claim 11 wherein two or more of said ordinal range ranks are selected with equal frequency and are most frequently selected ranks for a game playing interval $L_n$, the winning rank is determined from the corresponding rank having the higher frequency of selection for game playing interval $L_{n+1}$.

16. A method according to claim 11 wherein two or more of said integers are selected with equal frequency for a game playing interval $L_n$, the integer placed higher in said decreasing order of frequency of selection for integers is determined from the corresponding integer having the higher frequency of selection for game playing interval $L_{n+1}$.

17. A method according to claim 11 wherein said game winning player's selection matches the most frequently selected rank R and integer N associated with said most frequently selected rank R in said one-to-one correlation set for each corresponding game playing interval L.

18. A method according to claim 11 wherein no game player's selection matches the most frequently selected rank R and integer N associated with said most frequently selected rank R in said one-to-one correlation set for each corresponding game playing interval L, said game winning player's selection matches the greatest number of most frequently selected rank R for each game playing interval L.

19. A method according to claim 11 wherein no game player's selection matches the most frequently selected rank R and integer N associated with said most frequently selected rank R in said one-to-one correlation set for each corresponding game playing interval L, two or more players selection matches an equal number of most frequently selected rank R for each game playing interval L, said game winning player's selection matches the greatest number of integers N associated with said most frequently selected rank R for each game playing interval L.

20. A method according to claim 11 wherein no game player's selection matches the most frequently selected rank R and integer N associated with said most frequently selected rank R in said one-to-one correlation set for each corresponding game playing interval L, two or more players selection matches an equal number of most frequently selected rank R for each game playing interval L, and an equal number of integers N associated with said most frequently selected rank R for each game playing interval L, said players having made said selections share said awarded prize.

* * * * *